United States Patent [19]

Ketner

[11] Patent Number: 4,473,304

[45] Date of Patent: Sep. 25, 1984

[54] TOROIDAL TIME PIECE

[76] Inventor: Eugene N. Ketner, P.O. Box 836, Graham, Tex. 76046

[21] Appl. No.: 337,110

[22] Filed: Jan. 5, 1982

[51] Int. Cl.[3] ..... G04B 19/00; G04B 37/00

[52] U.S. Cl. ..... 368/281; 368/221; 368/223; 368/276; 368/77

[58] Field of Search ..... 368/77, 88, 221, 223, 368/228, 232, 233, 276, 281, 284, 297, 298, 285

[56] References Cited

U.S. PATENT DOCUMENTS

| | | | |
|---|---|---|---|
| 3,712,046 | 1/1973 | Dill | 368/85 |
| 3,952,499 | 4/1976 | Reisman | 368/276 |
| 3,968,639 | 7/1976 | Berets et al. | 368/84 |
| 4,253,178 | 2/1981 | Kolaczia | 368/285 |

FOREIGN PATENT DOCUMENTS

| | | | |
|---|---|---|---|
| 53-76073 | 7/1978 | Japan | 368/232 |

*Primary Examiner*—Forester W. Isen

*Attorney, Agent, or Firm*—Marcus L. Bates

[57] ABSTRACT

A toroidal time piece for indicating the time of day. The toroidal time piece comprises a body having opposed faces with there being a relatively large window formed through the body. Each of the opposed faces has a boundary which extends about and defines the configuration of the window and the configuration of a peripheral edge of the body. The body and the window take on various different configurations to impart different artistic appearances into the time piece.

17 Claims, 20 Drawing Figures

FIG. 1
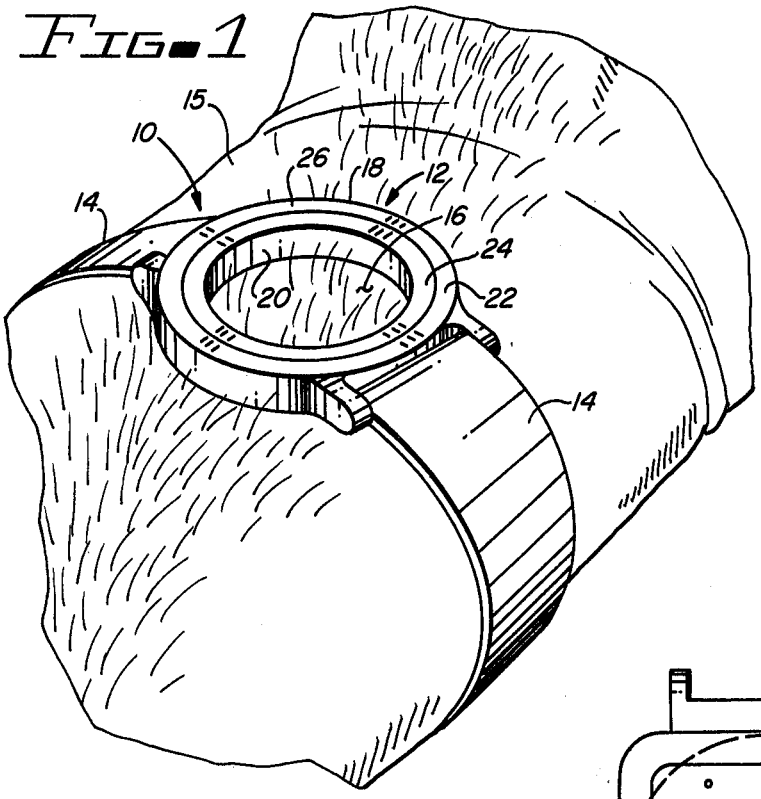
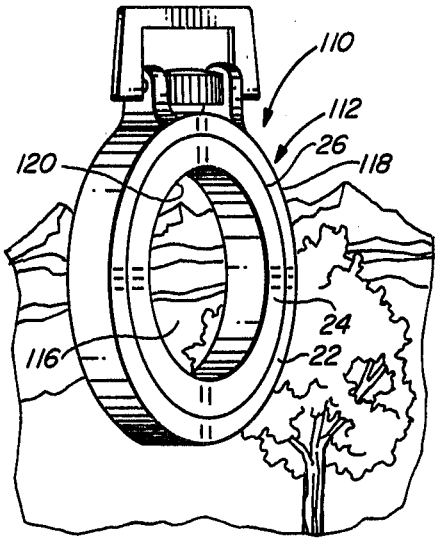
FIG. 2
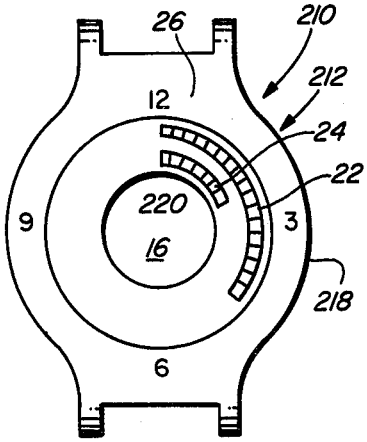
FIG. 3
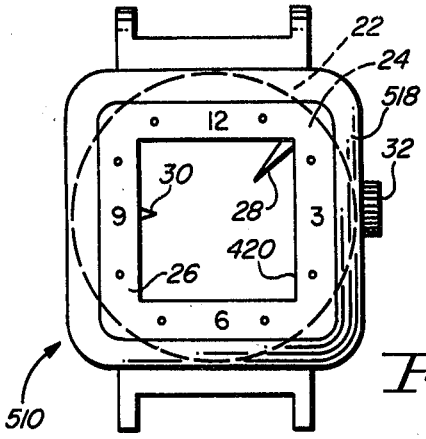
FIG. 6
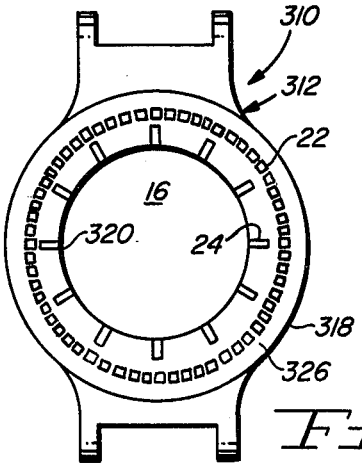
FIG. 4
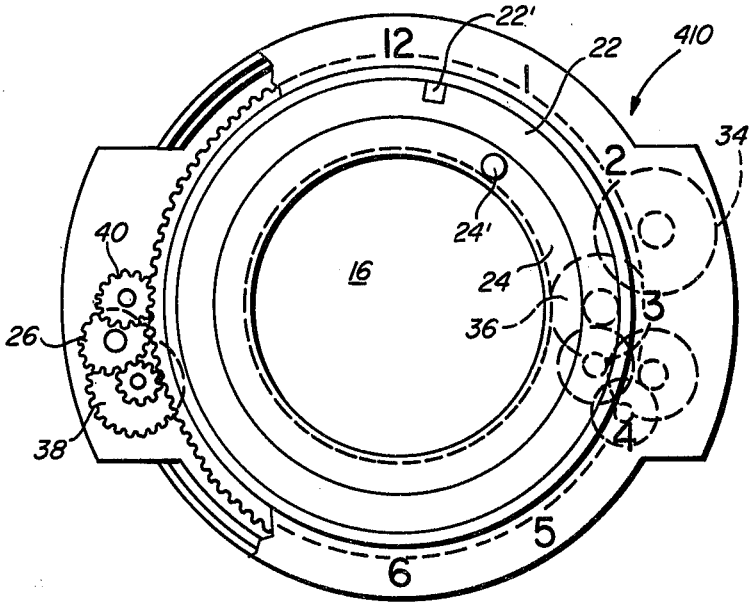
FIG. 5

TOROIDAL TIME PIECE

BACKGROUND OF THE INVENTION

The novel concept of a toroid shaped time piece as set forth herein greatly enhances the ability to bring new innovative styling to watches. The customary status of the art design is limited to decorations, such as diamonds, on the outer circumference of a watch. The new toroidal design of this invention allows various designs which include an additional inner circumference that can be decorated as may be desired. More surface area is therefore available for decorations. Further, it allows numerous designs to be incorporated into the toroidal time piece concept.

Personal identity can now be an integral part of the time piece. Initials, logos, decorations, and various combinations thereof can be incorporated into the window or aperture of the time piece to provide various different novel configurations which satisfies the preference of the individual.

SUMMARY OF THE INVENTION

This invention relates to a toroidal time piece and specifically to a toroidal time piece comprising a body having opposed faces, with there being an aperture formed through the body and the opposed faces which forms a window. Indicator means related to time keeping are provided on one of said faces, and means are provided within the body by which the indicator means provides data related to the time of day.

In the preferred embodiment of the invention, one face of the time piece is made into independently movable concentric discs which are moved relative to one another and to the main body. One of the discs is related to the hours of the day and the other disc is related to the minutes of the hour The relative movement between the body and the two discs is such that the time of day is always indicated by the relative position of the discs.

The main body of this embodiment is circular in form and includes a relatively large circular aperture formed more or less centrally therethrough. In an alternant embodiment of the invention, the main body is rectangular in configuration and includes a rectangular aperture formed therethrough.

In other embodiments of the invention, the aperture is made into a configuration to resemble a plurality of windows, a horseshoe, a drilling rig, and a series of circles.

In another form of the invention, the indicia includes an optically displayed digital time indication.

In another form of the invention, the indicator means is made up of electro optical devices such as liquid crystal devices, arranged to present radial bars divided into an inner segment and an outer segment with the segments being illuminated by an electric drive circuit.

Accordingly, a primary object of the present invention is the provision of a time piece which is artistic in appearance and irresistibly pleasing to the eye.

Another object of the present invention is the provision of a time piece made in the form of a toroid.

A further object of the present invention is the provision of a time piece having opposed faces, with there being a common aperture formed through each of the faces to thereby provide a window through the interior of the watch through which distant objects can be viewed.

Still another object of the present invention is the provision of a time piece in the form of a toroid with there being indicia applied to one face of the watch and means by which the indicia is related to the time of day.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a fragmentary, perspective view of a time piece made in accordance with the present invention attached to a person's wrist;

FIG. 2 is another perspective view of the watch of FIG. 1, with the watch being suspended in space;

FIG. 3 is a top plan view of a time piece which represents an alternant embodiment of the present invention;

FIG. 4 sets forth another alternant embodiment of the present invention;

FIG. 5 is an enlarged, top plan view of still another embodiment of the present invention;

FIG. 6 is a top plan view of a different embodiment of the present invention;

DETAILED DESCRIPTION OF THE PREFERRED EMBODIMENTS

Figure 7:
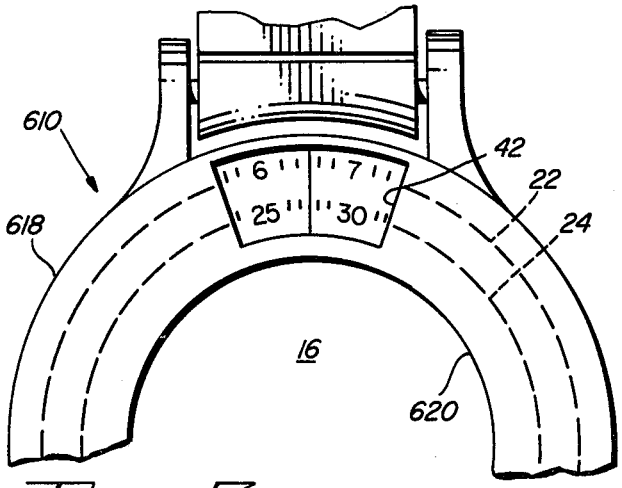
FIG. 7 is a fragmentary, top plan view which is an illustration of still another embodiment of the present invention.

In FIG. 1, there is disclosed a toroidal time piece 10 made in accordance with the present invention. The time piece includes a main body 12 to which there is attached a watch band 14 so that the watch can be conveniently supported upon one's wrist 15.

An aperture 16 extends through the main body of the watch. The outer surface 18 of the watch is circular and is interrupted by the lugs or ears which accommodate the band 14. The outer face of the watch has indicator means 22 and 24 related to time keeping formed thereon. Specifically, outer face 22 is in the form of a disc and is related to hours. The disc rotates respective to the main body. Inner face 24 is also in the form of a disc and is related to minutes. The discs rotate independently of one another and respective to the main body. The inner and outer rotating discs are concentric with respect to one another and are connected to a gear train which imparts proper relative movement thereinto for achievement of proper time keeping, as will be more fully discussed later on in this disclosure.

In FIG. 2, the toroidal time piece is shown suspended in space to further illustrate that distant objects can be viewed through the aperture. The time piece of FIG. 2 can be made in the form of a pocket watch, if desired, while remaining within the comprehension of this invention.

In the embodiment of FIG. 3, the time piece 210, for purposes of illustration, is shown in the form of a wrist watch. The outer face 26 of the watch has indicia formed there upon related to time keeping. Indicator means 22, 24 is formed between the outer wall 218 and inner wall 220 of the main body. The indicia at 22 and 24 preferable is in the form set forth in U.S. Pat. No. 3,844,105 to T. Kashio of Tokyo, Japan.

Kashio teaches that rectangular indicator elements made of liquid crystal substance are arranged at a loop line on a display panel and oriented radially to form an indication section. A second similar section is concentrically mounted inboard of the outer section, and the latter receives minute outputs from digitally driven time counting means to cause the outer section to perform minute indications while the inner section is arranged to perform hour indications Reference is made to the details of this disclosure for further explanation of the operation thereof.

In FIG. 5, there is disclosed a time piece in the form of a oblated doughnut having a relatively large circular aperture 16 formed centrally therethrough. A gear train at 34, 36, and 38 drives a pair of rotatable concentric discs 22 and 24. The concentric discs include indicators 22' and 24' thereon which indicate the time in minutes and hours by reference to the fixed indicia 1–12 placed about the illustrated fixed portion of the main body.

In the embodiment 510 set forth in FIG. 6, minute and hour pointers, 28 and 30, extend inwardly from the main body into the void presented by the square aperture formed by sidewall 420. The pointers, 28 and 30, preferably are moved about the circumference 22 by means of concentric or overlying discs such as seen in FIG. 5.

In FIG. 7, there is disclosed a toroidal watch 610 having an aperture 16 formed therethrough by means of sidewall 620. Within the main body, there is disclosed concentric discs, 22 and 24, similar to the discs of the embodiment of FIG. 5. One window 42 overlies the concentric discs and displays the illustrated numerals related to time keeping.

Figure 8:
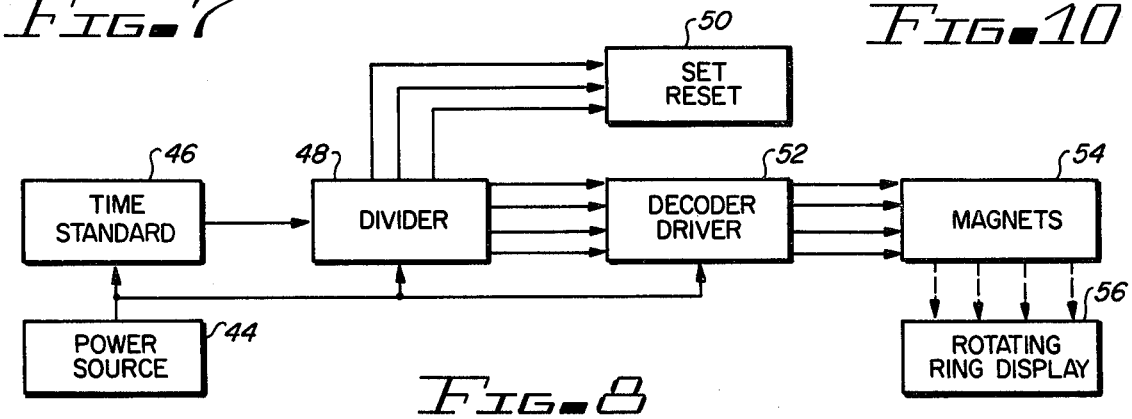
FIG. 8 diagrammatically illustrates the details of the operation of one of the foregoing time pieces.

FIG. 8 sets forth a block schematic diagram of an electronic time piece presented in H. G. Hill U.S. Pat. No. 3,712,046. to H. G. Hill. The time piece indicates time by means of a rotating ring display, as seen in FIG. 7, for example. The time piece can also take on the form of FIG. 10, wherein the pointers 22 and 24 are connected to independentally rotatable co-planer concentric rings.

In FIG. 7, the time is displayed in window 42 by means of two separately independentally rotatable co-planer concentric rings 22 and 24. Each ring carries a plurality of magnetic domains and is independentally stepped by a set of electro magnets driven by a multiphase pulse train in the manner of U.S. Pat. No. 3,712,046 to which reference is made for the details thereof.

Figure 9:
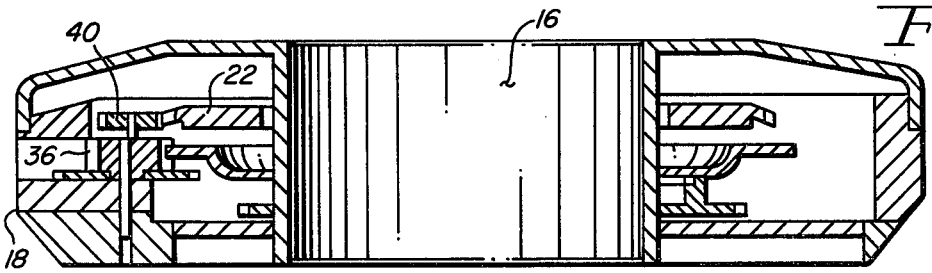
FIG. 9 is an enlarged, cross-sectional view of a time piece made in accordance with the present invention.

In FIG. 9, there is disclosed two co-axial discs of angular construction 22 and 24 which are driven by gear train 36 and 40. Disc 22 carries the minute indicating part of the time piece, while disc 24 carries the hour indicating part thereof. The drive train is powered by either an electric or mechanical spring motor, the details of which are not shown.

Figure 11:
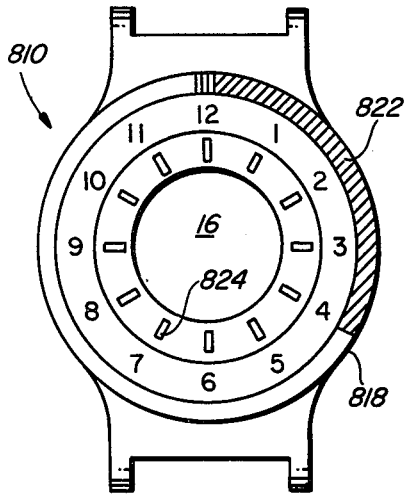
FIGS. 11–17 and 20 are top plan views of other embodiments of the present invention.

In FIG. 11, there is disclosed a toroidal time piece 810 having a colored ring 822 which indicates minutes, and radially spaced bars 824 for indicating hours. The ring and bars are operated in accordance with U.S. Pat. No. 3,968,639, to D. J. Berets, to which reference is made for the circuitry details and operation thereof.

Figure 12:
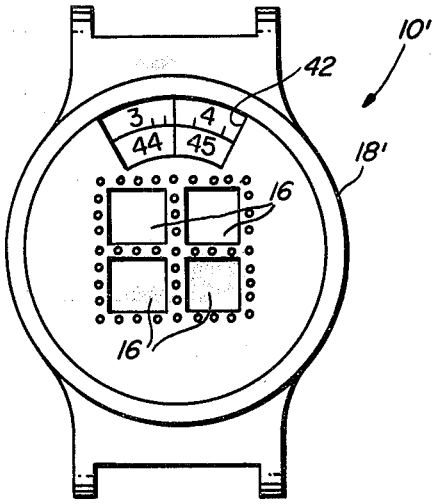
Figure 13:
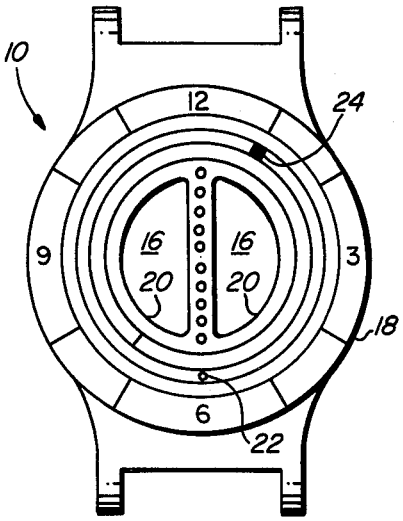

In FIG. 12, there is disclosed a time piece 10' having a main body through which there is formed a plurality of apertures 16. A window 42 provides visual observation of a portion of two coplaner independentally rotatable rings having the indicated hour and minute formed thereon. The rings are rotated by means contained within the main body of the time piece, and can take on a form similar to one of the foregoing embodiments of this invention.

Figure 14:
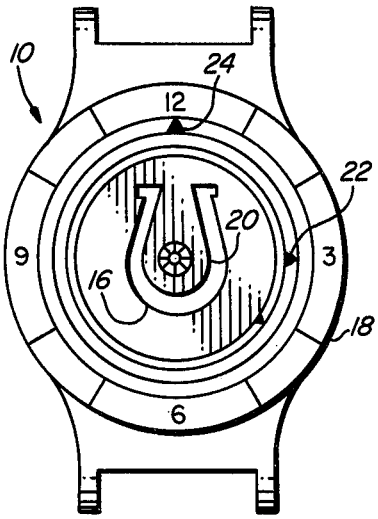
Figure 15:
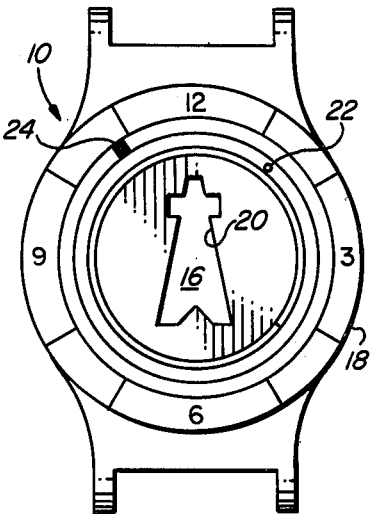
Figure 16:
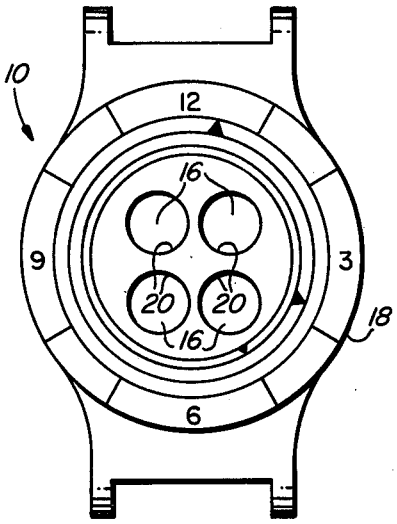

FIGS. 13–17 and 20 show various different configurations of apertures formed through a toroidal time piece. The toroidal time piece of FIG. 13 includes an aperture in the form of two crescent shaped voids which essentially amount to a hole having a bridge formed across the center thereof. The aperture of FIG. 14 is in the form of a horseshoe, while the aperture of FIG. 15 is in the form of a oil well derrick. The aperture of FIG. 16 is similar to the embodiment of FIG. 12 and includes four radially spaced apertures 16 formed by circular sidewalls 20.

Figure 10:
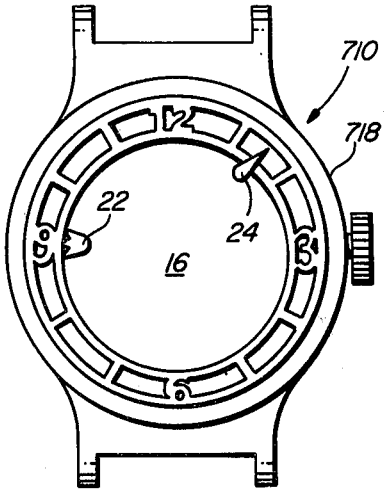
FIG. 10 is a top plan view of another embodiment of the present invention.
Figure 17:
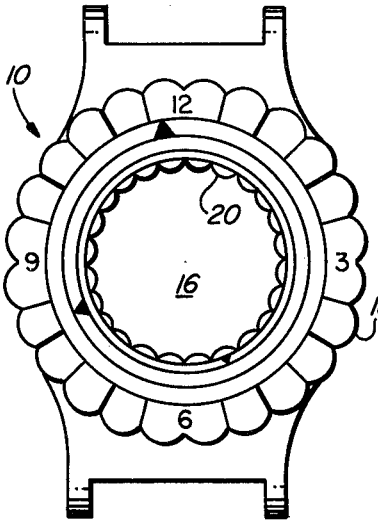
Figure 20:
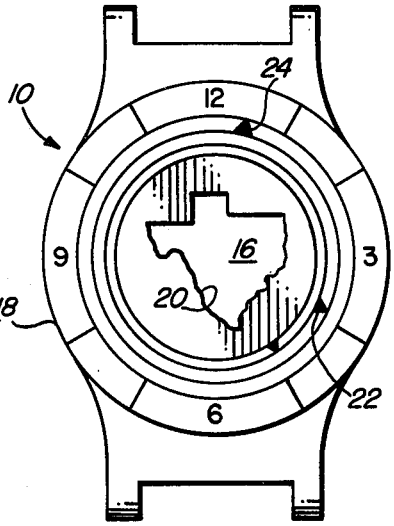

The apertured time piece of FIG. 17 is similar in many respects to the embodiment set forth in FIG. 10, and includes the aperture 16 formed by a rosetted sidewall 20.

Figure 18:
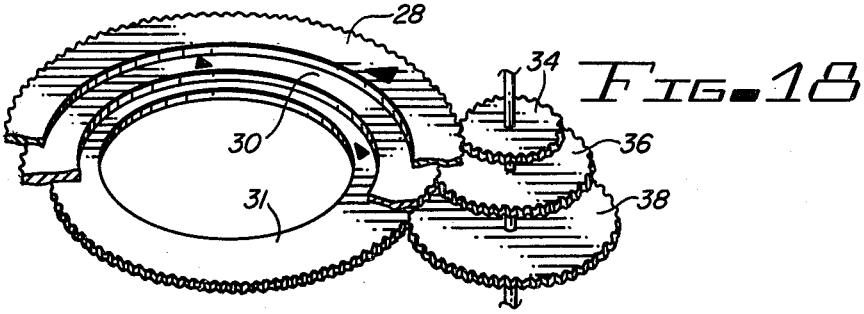
FIG. 18 is a broken, perspective view illustrating the drive train of one of the foregoing watches; and, FIG. 19 is a cross-sectional view of the drive train seen in FIG. 18.
Figure 19:
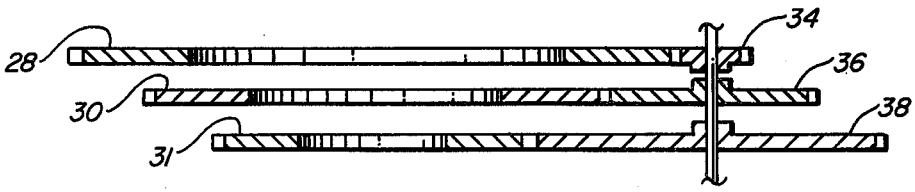

FIGS. 18 and 19 sets forth a gear train comprised of gears 34, 36, and 38 for driving concentric rings 28, 30, and 31, wherein the ring 31 is related to seconds, the ring 30 to minutes, and the ring 28 to hours. The gear train can be driven by a electric or a mechanical motor, and can advantageously be used in conjunction with the embodiment set forth in FIGS. 5, 6, 7, and 10.

The present invention provides a toroidal time piece comprising an annular body having opposed faces, with the aperture being formed through the body which results in each of the opposed faces also being apertured, and each of the faces assume a boundary which extends about and defines the geometrical configuration of the faces and the configuration of the aperture. Indicator means related to time keeping is included near the face. Means forming indicia is provided on one of the faces, with the indicia being related to hours and minutes of the day. Means are housed within the annular body by which the indicator means provides data related to the time of day.

The aperture through the main body which forms the time piece into a toroidal configuration can take on many different forms as set forth in the drawings.

In the specification, the term "relatively large aperture" is intended to mean a sight hole having a mean diameter at least one-fourth of the mean outside diameter of the watch, and preferably a hole which is one-half the mean diameter of the watch. When the outside diameter and the inside diameter of the watch are both unduly increased, the watch favors the form of a bracelet rather than a wrist watch, and this type of toroidal time piece is also included in the intellectual property deemed to be embraced by Applicant's claims. On the other hand, when the aperture is unduly reduced in diameter, a configuration is ultimately reached wherein the time piece no longer resembles a doughnut, or toroid, and such a small aperture is not deemed to be embraced by the term "relatively large aperture".

I claim:

1. A toroidal time piece comprising a body having opposed faces, means forming an aperture through each of said opposed faces to thereby provide a window through the time piece, said aperture results in each of said opposed faces assuming a boundary which extends about and defines the configuration of said window and the configuration of the peripheral edge of said body;

said window has a mean diameter which is at least one-fourth the mean overall diameter of the main body;

indicator means on one of said faces related to time keeping, means housed within the interior of said body by which said indicator means provides data related to the time of day.

2. The time piece of claim 1 wherein said indicator means includes indicia related to the minutes and hours of the day; and further including means associated with said indicia for indicating the time of day.

3. The time piece of claim 1 wherein said indicator means includes two spaced, co-axial members freely movable respective to one another with one of said members being related to minutes and the other of said members being related to hours; and, said means housed within the interior of said body imparts relative movement into said members.

4. The time piece of claim 1 wherein said window is a cylindrical surface which results in said main body assuming an annular configuration, and further including lugs formed on said body by which the time piece can be attached to one's wrist.

5. The time piece of claim 4 wherein said main body is cylindrical in form and said window is centrally located respective thereto;

said indicator means includes indicia related to the minutes and hours of the day; and further including means associated with said indicia for indicating the time of day.

6. The time piece of claim 5 wherein said indicator means includes two spaced, co-axial members freely movable respective to one another with one of said members being related to minutes and the other of said members being related to hours; and, means for imparting relative movement into said members.

7. The time piece of claim 4 wherein said indicator means is concentric circles of electrochromic display means electrically connected to an electric current flow means to cause said display to change color in a continually advancing manner as a function of said current flow so as to indicate accumulated electric current flow.

8. The time piece of claim 7 wherein said concentric circles of electrochromic display means comprises a plurality of radially spaced elements arranged to indicate elapsed time.

9. The time piece of claim 7 wherein said concentric circles of electrochromic display means comprises spaced circumferentially extending bands of said display means which is progressively actuated to change color along the circumference thereof to thereby indicate elapsed time.

10. The time piece of claim 1 wherein said main body is in the form of a polygon, and said aperture is in the form of another polygon.

11. The time piece of claim 1 wherein said main body is circular in form and said window is comprised of four windows.

12. The time piece of claim 1 wherein said main body is circular in form and said window is comprised of four circles.

13. The time piece of claim 1 wherein said main body is circular in form and said window is comprised of two adjacent crescents.

14. The time piece of claim 1 wherein said main body is circular in form and said window is in the form of a horseshoe.

15. The time piece of claim 1 wherein said main body is circular in form and said window is in the form of an oil derrick.

16. The time piece of claim 1 wherein said window formed through said main body defines a cylindrical surface which results in said main body assuming an annular configuration, and further including lugs formed on said body by which the time piece can be attached to one's wrist;

said indicator means includes two spaced, co-axial members freely movable respective to one another with one of said members being related to minutes and the other of said members being related to hours; and, means for imparting relative movement into said members and further including a spring motor connected to a gear train which in turn is connected to impart rotational motion into said co-axial members.

17. A time piece comprising a main body having opposed faces; means forming indicia on one of said opposed faces; said indicia is related to time keeping;

indicator means associated with said indicia for indicating the time of day;

a passageway extending through said main body, said passageway has an inner wall surface which defines a window, said passageway extends through each of said opposed faces, thereby causing said main body to assume the form of a toroid, said window has a mean inside diameter which is at least 25% of the mean outside diameter of said main body;

and means contained within the toroidal main body for actuating said indicator means and thereby provide the time of day.

* * * * *